US006625954B2

(12) United States Patent
Forrest

(10) Patent No.: US 6,625,954 B2
(45) Date of Patent: Sep. 30, 2003

(54) ROTARY FILM CLAMP ASSEMBLY FOR FILM WRAPPING OR PACKAGING MACHINES, AND METHOD OF OPERATING THE SAME

(75) Inventor: Stephen Forrest, Montreal (CA)

(73) Assignee: Illinois Tool Works Inc., Glenview, IL (US)

( * ) Notice: Subject to any disclaimer, the term of this patent is extended or adjusted under 35 U.S.C. 154(b) by 12 days.

(21) Appl. No.: 10/055,909

(22) Filed: Jan. 28, 2002

(65) Prior Publication Data

US 2003/0140599 A1 Jul. 31, 2003

(51) Int. Cl.[7] ..... B65B 11/04
(52) U.S. Cl. ..... 53/399; 53/587
(58) Field of Search ..... 53/399, 441, 556, 53/587, 465, 211

(56) References Cited

U.S. PATENT DOCUMENTS

| | | | | | |
|---|---|---|---|---|---|
| 4,077,179 | A | * | 3/1978 | Lancaster et al. | 53/441 |
| 4,216,640 | A | * | 8/1980 | Kaufman | 53/556 |
| 4,302,920 | A | | 12/1981 | Lancaster et al. | |
| 4,432,185 | A | * | 2/1984 | Geisinger | 53/587 |
| 4,497,159 | A | | 2/1985 | Lancaster, III | |
| 4,619,102 | A | * | 10/1986 | Geisinger | 53/399 |
| 4,914,891 | A | | 4/1990 | Suolahti | |
| 4,993,209 | A | * | 2/1991 | Haloila | 53/399 |
| 5,088,270 | A | * | 2/1992 | Diehl | 53/399 |
| 5,138,818 | A | * | 8/1992 | Humphrey | 53/556 |
| 5,414,979 | A | | 5/1995 | Moore et al. | |
| 5,447,008 | A | | 9/1995 | Martin-Cocher | |
| 5,447,009 | A | * | 9/1995 | Oleksy et al. | 53/399 |
| 5,452,566 | A | * | 9/1995 | Benhamou et al. | 53/556 |
| 5,477,658 | A | | 12/1995 | Berger et al. | |
| 5,862,647 | A | | 1/1999 | Scherer et al. | |
| 5,941,049 | A | * | 8/1999 | Lancaster et al. | 53/399 |

* cited by examiner

*Primary Examiner*—Stephen F. Gerrity
(74) *Attorney, Agent, or Firm*—Schwartz & Weinrieb

(57) ABSTRACT

A film clamping mechanism for use in connection with film wrapping apparatus comprises a pair of film clamping fingers or members which are movable between first and second CLOSED and OPENED states for respectively clamping and releasing a leading end portion of a wrapping film, and between first and second RAISED and LOWERED states for respectively clamping the leading end portion of the wrapping film at the commencement of the film wrapping operation and for maintaining the leading end portion of the wrapping film during the film wrapping operation. In this manner, since the clamping fingers are disposed at their LOWERED state during the film wrapping operation, such clamping fingers or members do not pose any interference with the carriage assembly upon which the supply of wrapping film is disposed whereby the carriage assembly can be disposed at its lower-most position in order to securely wrap loads having relatively small height dimensions as well as to shorten the film wrapping operation as well as to reduce the amount of wrapping film required for a particular film wrapping operation.

24 Claims, 5 Drawing Sheets

ROTARY FILM CLAMP ASSEMBLY FOR FILM WRAPPING OR PACKAGING MACHINES, AND METHOD OF OPERATING THE SAME

FIELD OF THE INVENTION

The present invention relates generally to film wrapping or packaging machines, and more particularly to a new and improved film clamping assembly which facilitates the wrapping or packaging of loads within wrapping or packaging film in a more secure manner, particularly short loads having relatively small height dimensions, which facilitates the wrapping or packaging of loads within the wrapping or packaging film in less time and with less wrapping or packaging film required for the overall film wrapping or packaging cycle or operation, which facilitates the wrapping or packaging of loads within the wrapping or packaging film without encountering or developing any interference between the film clamping assembly and the wrapping or packaging film, and which facilitates the wrapping or packaging of loads within the wrapping or packaging film by reducing the risk of tearing of the film during the packaging or wrapping operation or cycle.

BACKGROUND OF THE INVENTION

Film wrapping or packaging machines are of course well-known in the industry and are exemplified by means of U.S. Pat. No. 5,862,647 which issued to Scherer et al. on Jan. 26, 1999, U.S. Pat. No. 5,477,658 which issued to Berger et al. on Dec. 26, 1995, U.S. Pat. No. 5,447,008 which issued to Martin-Cocher on Sep. 5, 1995, U.S. Pat. No. 5,414,979 which issued to Moore et al. on May 16, 1995, U.S. Pat. No. 4,914,891 which issued to Suolahti on Apr. 10, 1990, U.S. Pat. No. 4,497,159 which issued to Lancaster, III on Feb. 5, 1985, and U.S. Pat. No. 4,302,920 which issued to Lancaster et al. on Dec. 1, 1981. Film packaging or wrapping machines often comprise two different types of machines, that is, a first type wherein the load to be wrapped is disposed upon a turntable which rotates the load relative to a supply roll of wrapping or packaging film which is mounted upon a vertically reciprocably movable carriage mechanism, or a second type wherein the load is stationary, and the vertically reciprocably movable carriage mechanism, having the supply roll of wrapping or packaging film mounted thereon, is mounted upon an arm or boom which rotates around the load. In either type of machine or system, a film clamping mechanism is provided for initially clamping or grasping a leading end portion of the wrapping or packaging film so as to properly position or orient the leading end portion of the wrapping or packaging film in connection with the subsequent initiation and application of the wrapping or packaging film upon the load in accordance with the performance of a wrapping or packaging operation or cycle. Conventionally, such film clamping mechanisms comprise a pair of upstanding clamping members which are relatively movable with respect to each other between CLOSED and OPENED positions so as to clamp or grasp the wrapping or packaging film, or to unclamp or release the wrapping or packaging film, respectively. As a result of the upstanding disposition of the clamping members, as well as in view of their positional location within the vicinity of the load being wrapped or packaged, such conventional clamping members pose an operational or cyclic interference problem with the film dispensing mechanism which must be accommodated by means of the manner in which the wrapping or packaging operation or cycle is conducted.

For example, in view of the upstanding disposition of the clamping members, the vertically movable carriage member, upon which the supply roll of wrapping or packaging film is mounted, must initially be disposed at an elevational level above that of the upstanding clamping members such that the wrapping or packaging film does not encompass or envelop the clamping members thereby preventing their subsequent movement to their OPENED positions when release of the wrapping or packaging film is desired. In addition, when a load to be wrapped comprises a short load having a relatively small height dimension, and in view of the fact that the wrapping or packaging film is conventionally twenty inches (20.00") wide, and in view of the additional fact that the wrapping or packaging of the load must be commenced at an elevational level above that of the clamping members which can have a vertical extent of, for example, between eight and ten inches (8.00–10.00"), the wrapping or packaging film may only in effect be partially disposed upon the load whereby the wrapping or packaging film is not in fact securely disposed in its wrapped state upon the load.

Still further, when the wrapping or packaging operation or cycle is being completed, the carriage assembly, upon which the supply roll of wrapping or packaging film is disposed, cannot be continuously lowered to its lowermost travel position in order to enable the lowermost region of the load to be wrapped or packaged because, again, interference with the upstanding clamping members will occur. Accordingly, in order to compensate for, or accommodate, such potential interference so as to in fact avoid such operational interference, it is conventional for the downward movement of the carriage mechanism to be terminated at an elevational level which is above that of the upper extent of the clamping members so as to permit the clamping members to then be moved to their OPENED positions thereby enabling further lowering of the carriage assembly. However, opening of the clamping fingers obviously results in the release of the leading end or tail of the wrapping or packaging film which must then be immediately captured and secured by means of the packaging or wrapping film being wrapped around the load in order to prevent any subsequent difficulties in connection with the wrapping, packaging, or further processing of the load. However, depending upon the relative circumferential locations of the clamping mechanism and the carriage assembly from which the packaging or wrapping film is dispensed, which is a function of the size of the load and the wrapping or packaging of the same within the wrapping or packaging film, the turntable or rotating arm may have to be rotated a predetermined amount so as to circumferentially locate or position the clamping mechanism and the carriage assembly at a predetermined position with respect to each other just prior to the opening of the clamping members and the release of the leading end or tail of the wrapping or packaging film so as to effectively ensure the capture and securing of the leading end or tail of the wrapping or packaging film by means of the subsequently wrapped packaging or wrapping film.

Once this is accomplished, dispensing of the wrapping or packaging film in a horizontal reinforcing wrap mode is continued for several relative rotations of the load and the film dispensing assembly whereupon completion of the securing of the leading end or tail portion of the wrapping or packaging film, lowering of the carriage assembly is continued to its lowermost extent so as to complete the film wrapping or packaging operation. When the carriage assembly attains its lowermost position, further reinforcing or bottom wrapping of the load, as is well-known in the industry, is performed upon the lowermost portion of the load so as to complete the entire wrapping or packaging operation or cycle. Subsequently, the packaging or wrapping film can again be relatively disposed above the clamping members such that the clamping members can be moved to their CLOSED positions so as to once again clamp the wrapping or packaging film. A suitable film welding and cutting mechanism is then activated so as to secure a trailing end portion of the wrapping or packaging film to the load and to sever such trailing end portion of the wrapping or packaging film from the leading end portion of the wrapping or packaging film which is now clamped by means of the clamping members in preparation for a new film wrapping or packaging operation or cycle to be performed upon a new load. It can therefore be readily appreciated that in accordance with the PRIOR ART clamping assembly or mechanism, a dual or double horizontal reinforcing wrapping of the load within the vicinity of the clamping fingers and upon the bottom portion of the load has been necessary. This cyclic operation is wasteful both in connection with operational processing time as well as with respect to the use of additional wrapping or packaging film.

A need therefore exists in the art for a new and improved film clamping assembly, and a method of operating the same, for use in connection with film wrapping or packaging machines wherein in addition to the clamping members being movable with respect to each other between their OPENED and CLOSED states, the clamping members can be pivotally moved between a first vertically oriented RAISED position, during which time, for example, the clamping members can capture a portion of the wrapping or packaging film in preparation for the commencement of a wrapping or packaging operation or cycle, and a second horizontally oriented LOWERED position, during which time, for example, the clamping members can retain the captured portion of the packaging or wrapping film while the film wrapping or packaging operation or cycle is being performed, such that the clamping members do not present any interference with respect to the wrapping or packaging film being wrapped around the load, as a result of which, not only can the wrapping or packaging film be applied to the lowermost regions of the load, but in addition, cyclic operation time is shortened and less packaging or wrapping film is required to be used in connection with the wrapping or packaging of a particular load.

OBJECTS OF THE INVENTION

Accordingly, it is an object of the present invention to provide a new and improved film clamping assembly, and a method of operating the same, for use in connection with film wrapping or packaging machines.

Another object of the present invention is to provide a new and improved film clamping assembly, and a method of operating the same, for use in connection with film wrapping or packaging machines, wherein the new and improved film clamping assembly effectively overcomes the various operational drawbacks or disadvantages characteristic of conventional PRIOR ART film clamping assemblies.

An additional object of the present invention is to provide a new and improved film clamping assembly, and a method of operating the same, for use in connection with film wrapping or packaging machines, wherein the new and improved film clamping assembly does not cause any interference with the wrapping or packaging film being wrapped around the load during the wrapping or packaging operation or cycle.

A further object of the present invention is to provide a new and improved film clamping assembly, and a method of operating the same, for use in connection with film wrapping or packaging machines, wherein the new and improved film clamping assembly does not cause any interference with the wrapping or packaging film being wrapped around the load during the wrapping or packaging operation or cycle so as to enable the wrapping or packaging film to be wrapped around and applied to the lowermost regions of loads, as well as enabling the wrapping of short loads.

A last object of the present invention is to provide a new and improved film clamping assembly, and a method of operating the same, for use in connection with film wrapping or packaging machines, wherein the new and improved film clamping assembly does not cause any interference with the wrapping or packaging film being wrapped around the load during the wrapping or packaging operation or cycle so as to enable a reduced amount of the wrapping or packaging film to be wrapped around and applied to the load and in a relatively shortened operational cycle time.

SUMMARY OF THE INVENTION

The foregoing and other objectives are achieved in accordance with the teachings and principles of the present invention through the provision of a new and improved film clamping assembly, and a method of operating the same, for use in connection with film wrapping or packaging machines, wherein in addition to the clamping members being movable with respect to each other between their OPENED and CLOSED positions, the clamping members can be pivotally moved between a first vertically oriented RAISED position, during which time, for example, the clamping members can capture a portion of the wrapping or packaging film in preparation for the commencement of a wrapping or packaging operation or cycle, and a second horizontally oriented LOWERED position, during which time, for example, the clamping members can retain the captured portion of the packaging or wrapping film while the film wrapping or packaging operation or cycle is being performed. In this manner, the clamping members do not present any interference with respect to the wrapping or packaging film being wrapped around the load, as a result of which, not only can the wrapping or packaging film be applied to the lowermost regions of the load, but in addition, cyclic operation time is shortened and less packaging or wrapping film is required to be used in connection with the wrapping or packaging of a particular load.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
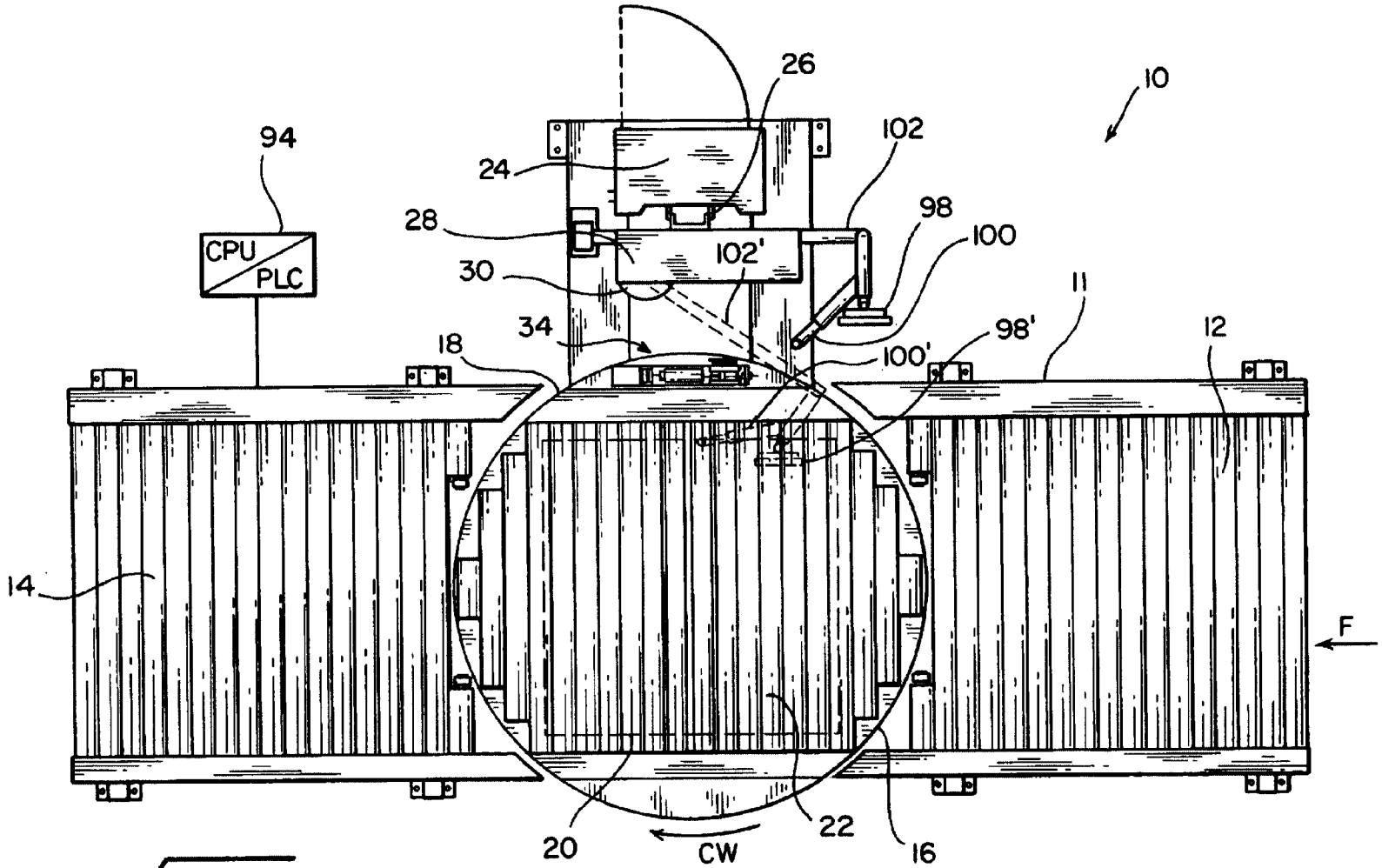
FIG. 1 is a top plan view of the new and improved film packaging or wrapping machine constructed in accordance with the principles and teachings of the present invention and showing the cooperative parts thereof.
Figure 2:
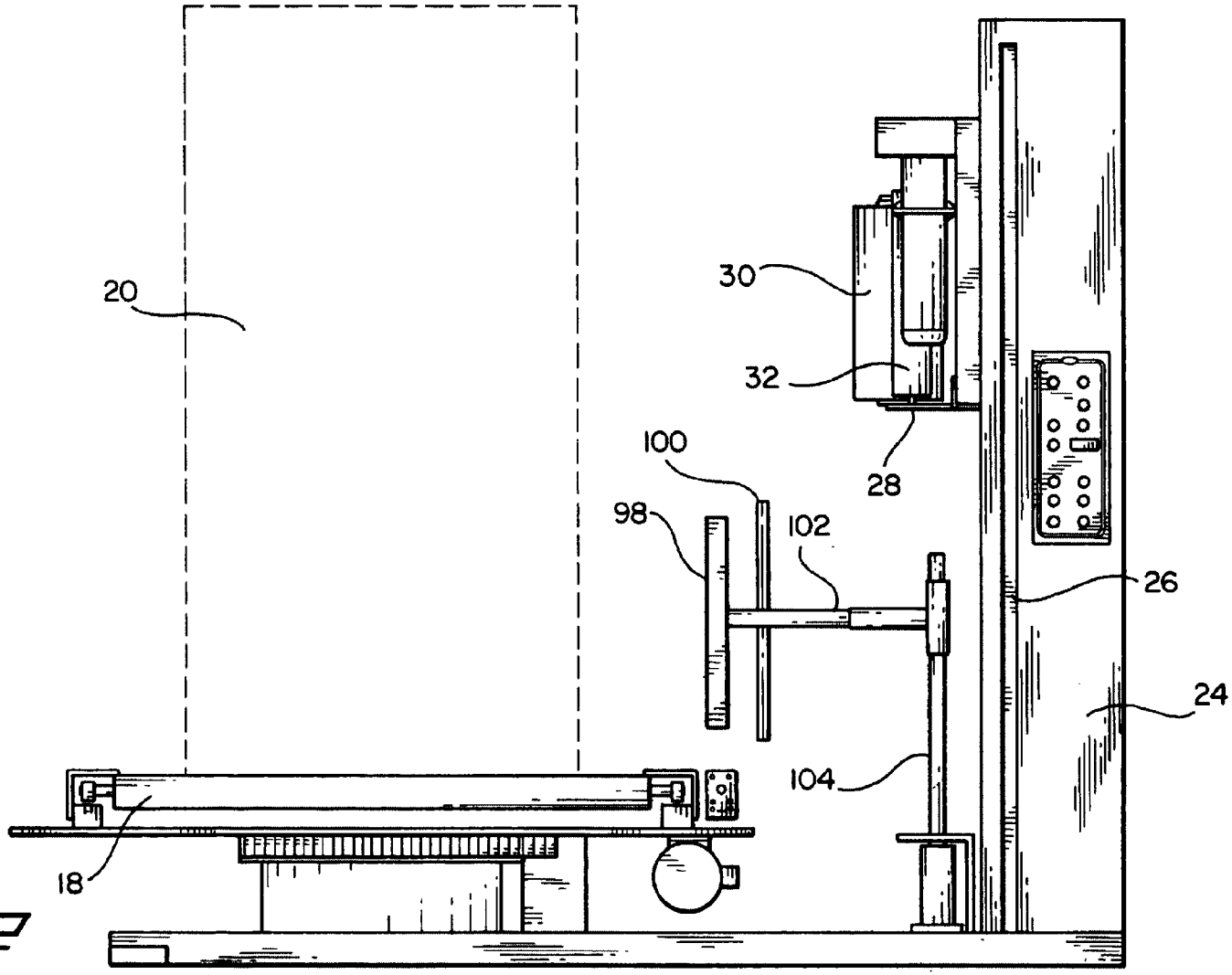
FIG. 2 is a side elevational view of the new and improved film wrapping or packaging machine as shown in FIG. 1.
Figure 3:
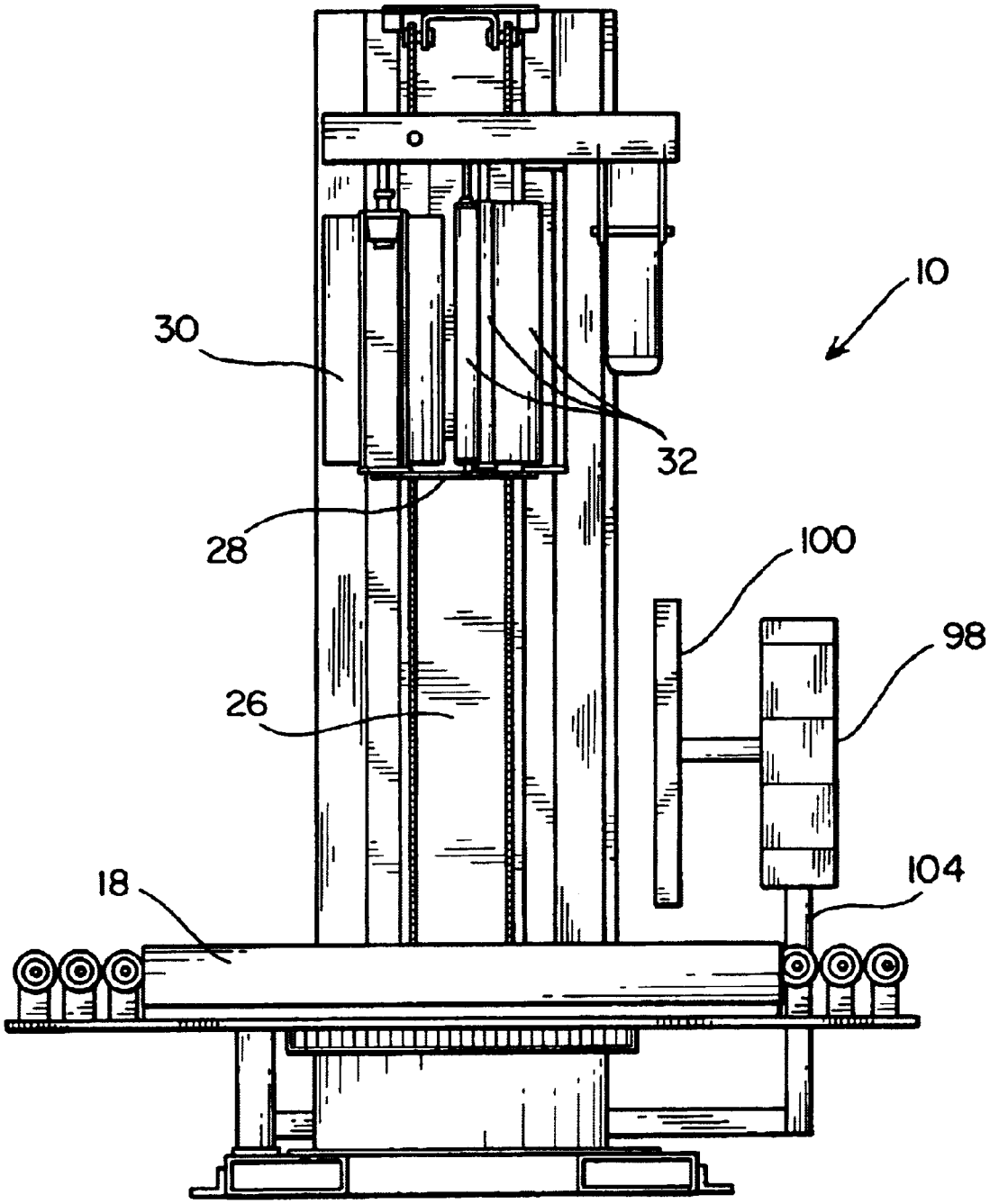
FIG. 3 is a front elevational view of the new and improved film wrapping or packaging machine as shown in FIGS. 1 and 2.

Referring now to the drawings, and more particularly to FIGS. 1–3 thereof, a new and improved film packaging or wrapping machine or system, constructed in accordance with the principles and teachings of the present invention, is disclosed thereby showing the cooperative parts thereof and is generally indicated by the reference character 10. As can be readily seen, the new and improved packaging or wrapping machine or system 10 comprises a conveyor system 11 which includes an upstream infeed roller conveyor 12 and a downstream outfeed roller conveyor 14 by means of which loads to be wrapped or packaged can be conducted, in a processing direction indicated by means of the arrow F, toward or into a wrapping or packaging station 16, as well as away from or out of the wrapping or packaging station 16, respectively. A turntable 18 is rotatably disposed at the wrapping or packaging station 16, and the turntable 18 is adapted to have a load 20 mounted thereon such that the load 20 can be wrapped or packaged within wrapping or packaging film when the turntable 18 is rotated, for example, in the clockwise direction as denoted by means of the arrow CW. The turntable 18 comprises a plurality of roller conveyors 22, and the system 10 is provided with suitable sensor means, not shown, operatively associated therewith so as to angularly position the turntable 18 at a predetermined home position, at predetermined times during the wrapping or packaging operation or cycle, at which, for example, the roller conveyors 22 of the turntable 18 will be disposed parallel to the roller conveyors of the upstream infeed and the downstream outfeed conveyors 12,14. Disposed along one long side of the conveyor system 11, and more particularly upon one side of the turntable 18, there is provided a vertically upstanding tower assembly 24 upon which there is fixedly mounted a vertically upstanding or oriented track assembly 26. As can best be appreciated from FIG. 2, a carriage assembly 28 is adapted to be movable in a vertically reciprocable mode along the track assembly 26, and as is conventional, the carriage assembly 28 has a supply roll of wrapping or packaging film 30, and a wrapping or packaging film dispensing assembly comprising a plurality of stretch rollers 32, mounted thereon for facilitating the supply of the wrapping or packaging film to the load 20 disposed upon the turntable 18 and located at the wrapping or packaging station 16 so as to wrapped or packaged within the wrapping or packaging film.

In accordance with the unique and novel structure comprising the present invention, a leading tail or leading end film clamping mechanism or assembly is mounted upon an outer peripheral edge portion of the turntable 18 as best seen in FIG. 1, the film clamping mechanism or assembly 34 is generally indicated by the reference character 34, and the interrelated structural details of the film clamping mechanism or assembly 34 may best be appreciated from FIGS. 4–8. More particularly, as may best be appreciated from FIGS. 4–8, the film clamping mechanism or assembly 34 comprises a pair of leading tail or leading end film clamping fingers or members 36,38 which are adapted to be movable with respect to each other, within a first vertically oriented plane, between RAISED, CLOSED and OPENED positions as respectively illustrated within FIGS. 4 and 8, and with respect to each other, within a second horizontally oriented plane, between LOWERED, CLOSED and OPENED positions as respectively illustrated within FIGS. 5, and 6 and 7, in order to achieve the capture and release of the leading end or leading tail of the wrapping or packaging film at or during predetermined times or portions of the wrapping or packaging operation or cycle as will be more fully appreciated hereinafter.

Figure 4:
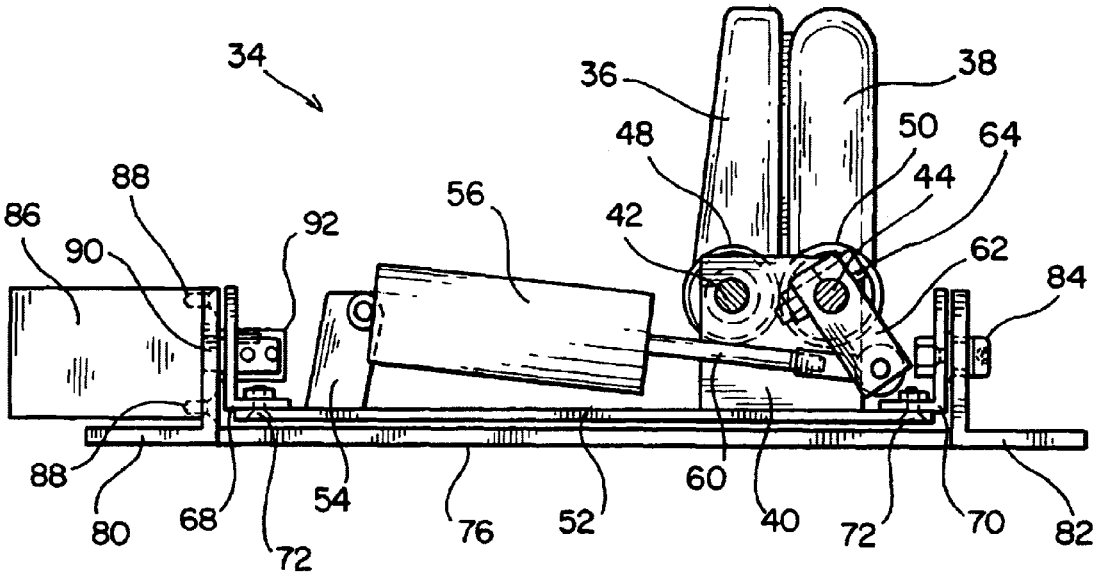
FIG. 4 is a front elevational view of the new and improved film clamping mechanism constructed in accordance with the principles and teachings of the present invention, as utilized within the new and improved film wrapping or packaging system as disclosed within FIGS. 1–3, and illustrating the clamping members disposed in their RAISED and CLOSED positions.

As specifically illustrated within, for example, FIG. 4, the pair of wrapping or packaging film clamping fingers or members 36,38 are normally disposed in their vertically upstanding RAISED and CLOSED positions such that the clamping fingers or members 36,38 operatively cooperate with each other in connection with, for example, the clamping therebetween of a leading end or tail portion of the packaging or wrapping film in preparation for the commencement of a wrapping or packaging operation or cycle. The clamping members 36,38 are respectively pivotally mounted upon the rear side or surface of a first vertically oriented mounting block 40, as may best be appreciated from FIG. 7, through means of a pair of axle shafts 42,44. The axle shafts 42,44 extend through suitable apertures formed within the first mounting block 40, and distal ends of the axle shafts 42, 44 extend through suitable apertures formed within a second vertically oriented mounting block 46 which is spaced from the first mounting block 40.

A pair of gear members 48,50 are fixedly mounted upon the axle shafts 42,44 so as to be respectively interposed between the clamping fingers or members 36,38 and the first mounting block 40, and the gear members 48,50 are enmeshed with each other such that the clamping fingers or members 36,38 rotate together in opposite directions, that is, either clockwise or counterclockwise, when the axle shafts 42,44 are rotated as a result of the relative rotation defined between the gear members 48,50. The first and second mounting blocks 40,46 are fixedly mounted upon a first end portion of a base member 52 so as to effectively form a clevis therewith, and an upstanding support bracket 54 is mounted upon a second end portion of the base member 52. A pneumatic piston-cylinder actuator assembly 56 has its cylinder end thereof mounted upon the support bracket 54 by means of suitable mounting brackets 58,58, and the piston rod 60 of the piston-cylinder actuator assembly 56 is operatively connected at its free end portion thereof to one end of a crank or lever arm 62. The other opposite end of the crank or lever arm 62, which has a split-type clamping structure, is interposed between the first and second mounting blocks 40,46 and is fixedly secured upon the axle shaft 44 as a result of the split end portions thereof being tightly clamped together around the axle shaft 44 by means of a suitable bolt fastener 64. A spacer or collar 66 is disposed around the axle shaft 42 and is likewise interposed between the first and second mounting blocks 40,46 so as to render the entire assembly structurally stable. In this manner, when the piston rod 60 is either extended or retracted, crank or lever arm 62 is accordingly pivoted in a predetermined direction so as to cause axle shaft 44 to rotate in a corresponding direction. Therefore, as a result of the disposition of gear member 50 upon axle shaft 44, and the enmeshed engagement defined between gear members 48,50, the rotation of gear members 48,50 will in turn cause the opposite rotational movements of the clamping fingers or members 36,38 between their CLOSED and OPENED positions.

Continuing further, as may best be appreciated from FIG. 4, opposite ends of the base member 52, upon which the mounting blocks 40,46 as well as the support bracket 54 are fixedly mounted, are affixed to angle irons or angle brackets 68,70 by means of suitable fasteners 72 such that together, the angle irons or angle brackets 68,70 and the base member 52 comprise an inner framework 74 having a substantially U-shaped cross-sectional configuration. In a similar manner, an outer framework 76, comprising a base member 78 and a pair of angle irons or angle brackets 80,82 welded to opposite ends thereof, pivotally mounts the inner framework 74 thereon such that the inner framework 74, having the clamping fingers or members 36,38 mounted thereon, is movable between a first position as shown, for example, in FIG. 4 at which the clamping fingers or members 36,38 are disposed at their vertically oriented RAISED positions, and a second position as shown, for example, in FIG. 5 at which the clamping fingers or members 36,38 at their horizontally oriented LOWERED positions. In order to achieve the 90° angular movement of the inner framework 74 from its position illustrated in FIG. 4 to that illustrated in FIG. 5, the angle iron or bracket 70 of the inner framework 74 is pivotally mounted upon the angle iron or bracket 82 of the outer framework 76 by means of a shoulder bolt assembly 84. Upon the oppositely disposed angle iron or bracket 80 of the outer framework 76 there is fixedly mounted a rotary actuator 86 by means of a plurality of fasteners 88. A rotary shaft 90 of the rotary actuator 86 extends through and is fixedly mounted upon angle iron or bracket 68 by means of a collar assembly 92. Accordingly, when the rotary actuator 86 is appropriately energized so as to rotate or pivot its rotary shaft 90 through, for example, an arcuate movement of 90°, the inner framework 74 will be accordingly rotated 90° relative to the outer framework 76 from the position shown in FIG. 4 to that shown in FIG. 5.

Having now described substantially all of the operative structural components comprising the new and improved packaging or wrapping machine or system 10 constructed in accordance with the principles and teachings of the present invention, the operation of the same, including the operation of the new and improved film clamping mechanism or assembly 34, will now be described. More particularly, a load 20 to be wrapped or packaged is initially conducted toward the wrapping station 16 by means of the infeed conveyor 12, and the conveyance of the load 20 is stopped upon the turntable 18 when the load 20 is substantially centered upon the turntable 18. The system 10 is also controlled, by means of suitable central processing unit (CPU) or programmable logic controller (PLC) 94, such that at the commencement of a load wrapping or packaging operation, the turntable 18 will be disposed at a predetermined angular, circumferential, or rotatable HOME or START position at which the film clamping mechanism or assembly 34 will be disposed at its closest position with respect to the vertically movable carriage assembly 28 upon which the supply roll 30 of packaging or wrapping film is disposed. At this point in time, the film clamping mechanism or assembly 34 will be disposed at the position illustrated within FIG. 4 whereby the clamping fingers or members 36,38 are disposed at their RAISED and CLOSED positions and in fact have the leading end or tail portion of the wrapping or packaging film, as the same extends from the supply roll 30 of packaging or wrapping film, grasped and retained therebetween. Accordingly, a load wrapping or packaging operation or cycle is therefore ready to be started or commenced.

Figure 5:
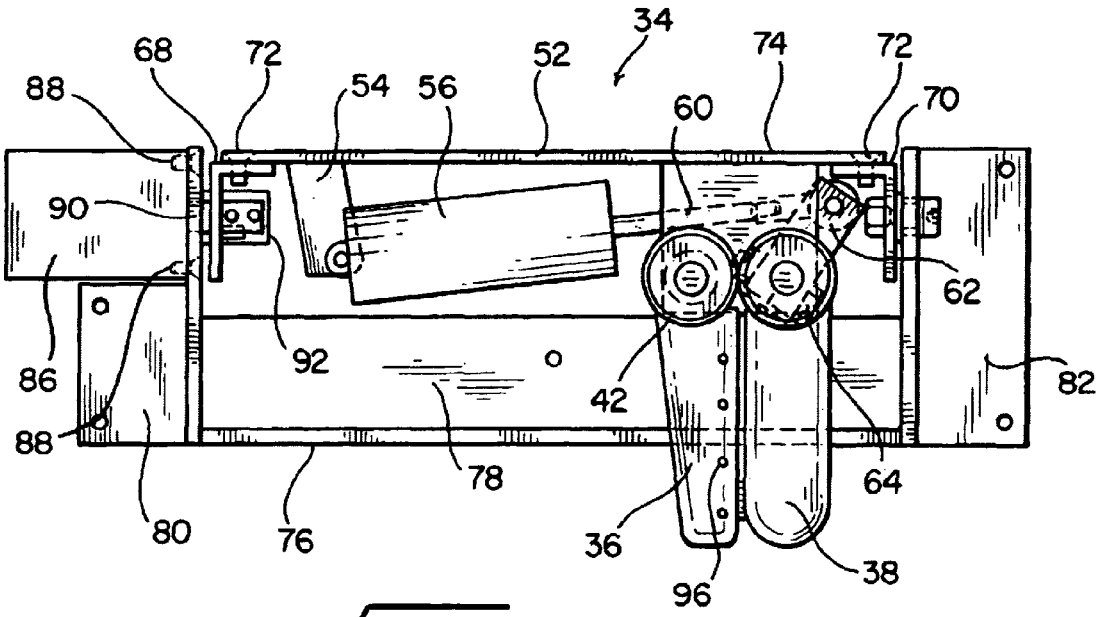
FIG. 5 is a top plan view of the new and improved film clamping mechanism as disclosed within FIG. 4 and illustrating the clamping members disposed in their LOWERED and CLOSED positions.

In accordance then with the load wrapping or packag operation or cycle, and in accordance with the unique and novel operation of the new and improved packaging or wrapping machine or system 10, and particularly in accordance with the operation of the new and improved film clamping mechanism or assembly 34, the rotary actuator 86 is firstly activated or energized so as to rotate the rotary shaft 90 thereof through an arcuate movement of 90° whereby the inner framework 74, which is effectively fixedly connected to the rotary actuator shaft 90, is likewise rotated through an arcuate extent of 90° such that the clamping fingers or members 36,38 are moved from their RAISED and CLOSED positions as illustrated within FIG. 4 to their LOWERED and CLOSED positions as illustrated within FIG. 5. Therefore, it is to be emphasized and appreciated that since the clamping fingers or members 36,38 are no longer disposed at their original or starting RAISED positions wherein the clamping finger or members 36,38 were originally disposed or oriented within a vertical plane, and are now disposed at their LOWERED positions wherein the clamping fingers or members 36,38 are disposed or oriented within a horizontal plane, the clamping fingers or members 36,38 do not present an obstacle, or serve as a means of interference, with the wrapping or packaging film that is about to be dispensed by and withdrawn from the carriage assembly 28 and the supply roll 30 of packaging or wrapping film.

Accordingly, in accordance with the principles and teachings of the present invention, the carriage assembly 28 is able to be disposed at its lowermost vertical position so as to in turn be capable of wrapping the lowermost region of the load 20 disposed upon the turntable 18 at the wrapping station 16. In other words, as a result of the incorporation of the new and improved clamping mechanism 34 into the new and improved packaging or wrapping machine or system 10, the carriage assembly 28 does not have to be initially disposed, at the start of the film wrapping or packaging operation or cycle, at an elevational level which is above that of the upstanding or vertically oriented clamping fingers or members, as was the case with conventional PRIOR ART film wrapping and packaging systems, because the clamping fingers or members 36,38 are able to be pivotally moved from an up-standing vertically oriented RAISED position to a horizontally oriented LOWERED position.

Continuing further then, as the turntable 18, upon which the load 20 is disposed, is rotated in the clockwise direction as indicated by means of the arrow CW, and in view of the fact that the leading end or tail of the wrapping or packaging film is grasped and retained by means of, and between, the clamping fingers or members 36,38 which are now disposed at the LOWERED and CLOSED positions, the packaging or wrapping film is withdrawn from the supply roll 30 of packaging or wrapping film. It is to be noted that an additional operative advantage of disposing the clamping fingers or members 36,38 at the noted LOWERED and CLOSED positions is that as the wrapping or packaging film is pulled and withdrawn from the supply roll 30 of the packaging or wrapping film, the tension forces attendant such pulling or withdrawal of the wrapping or packaging film from the supply roll 30 of the packaging or wrapping film are oriented along the longitudinal extents of the clamping fingers or members 36,38. Such is contrary to the conventional orientation of such tension forces over the ends or tips of the clamping fingers or members, which would be the case if the clamping fingers or members 36,38 were in fact disposed in a conventional RAISED position, whereby such conventionally oriented tension forces tend to initiate or potentially result in the tearing of the packaging or wrapping film. Continuing still further then, at the same time, or substantially simultaneously with the commencement of the rotation of the turntable 18, the carriage assembly 28 is moved upwardly along the track or rail assembly 26 whereby spiral wrapping of the load occurs. Accordingly, when the carriage assembly 28 reaches the top of the load 20, the carriage assembly 28 may be retained at its uppermost elevational level of travel for a predetermined period of time so as to permit, for example, several layers of reinforcing wrap to be applied to the load 20 whereupon completion of such reinforcing wrapping, the carriage assembly 28 is once again lowered, as the turntable 18 continues to rotate, so as to apply spiral wrapping to the load 20.

Figure 6:
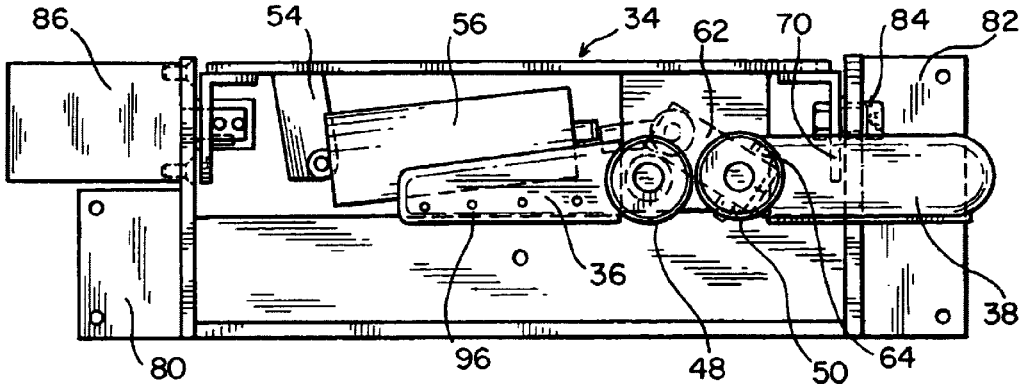
FIG. 6 is a top plan view of the new and improved film clamping mechanism as disclosed within FIG. 5 but illustrating the clamping members disposed in their LOWERED and OPENED positions.
Figure 7:
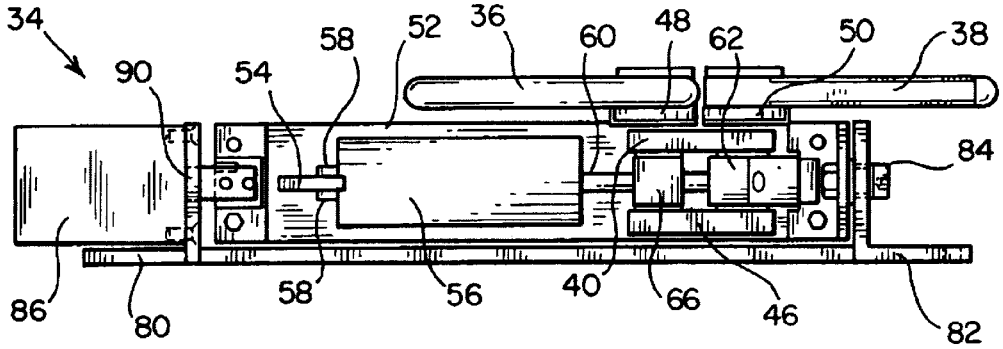
FIG. 7 is a front elevational view of the new and improved film clamping mechanism as disclosed within FIG. 6 and illustrating the clamping members disposed in their LOWERED and OPENED positions.

When the carriage assembly 28 then reaches its lowermost travel position, at least one bottom wrap layer is wrapped around the lowermost portion of the load 20 whereupon the pneumatic piston-cylinder actuator assembly 56 is actuated so as to retract the piston rod 60 and thereby move the clamping fingers or members 36,38, still in their LOWERED orientation, to their OPENED positions as illustrated in FIGS. 6 and 7 thereby releasing the leading end or tail portion of the wrapping or packaging film. As seen in FIGS. 5 and 6, for example, the clamping finger or member 36 is provided with a plurality of apertures 96 through which pneumatic jets of air are conducted from a suitable supply source, not shown. In view of the LOWERED disposition of the clamping fingers or members 36,38, the leading end or tail portion of the wrapping or packaging film is disposed relatively close to the wrapped or packaged load whereby the air jets can readily or easily forcefully control or move the now-released leading end or tail portion of the wrapping or packaging film into contact with the wrapped or packaged load whereupon continued rotation of the turntable 18, for at least one or two additional revolutions, serves to effectively secure the leading tail or end onto the wrapped or packaged load. It is to be noted that, as a result of the disposition of the clamping fingers or members 36,38 at their LOWERED positions during this phase of the film packaging or wrapping operation or cycle, and contrary to the practice or mode of operation characterized by the PRIOR ART system, the carriage assembly 28 of the machine or system 10 of the present invention can be lowered to its lowermost position without encountering any interference with the film clamping fingers or members, the carriage assembly 28 need not be momentarily paused in its lowered movement above the level of the film clamping fingers or members, and a dual horizontal or reinforcing wrapping mode of operation in connection with the securing of the leading end or tail portion of the wrapping or packaging film, which is otherwise wasteful both in connection with the time required for performance of the film wrapping or packaging operation or cycle as well as the amount of packaging or wrapping film required, need not be performed.

Figure 8:
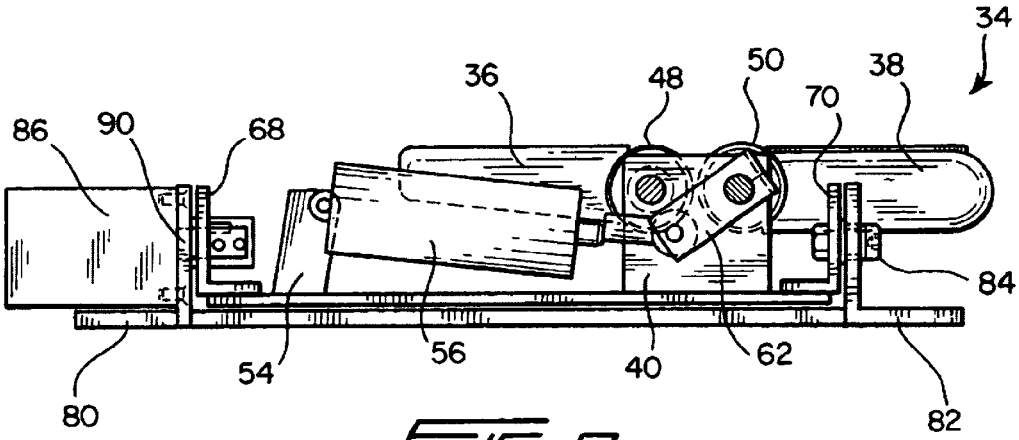
FIG. 8 is a front elevational view of the new and improved film clamping mechanism as disclosed within FIG. 7 but illustrating the clamping members disposed in their RAISED and OPENED positions.

Subsequently, rotation of the turntable 18 is terminated such that the turntable 18 is again located at the HOME or START position as illustrated in FIG. 1 whereby the film clamping mechanism or assembly 34 is again located at its position closest to the film carriage assembly 28 and the supply roll 30 of the wrapping or packaging film. Rotary actuator 86 can now again be actuated so as to pivotally or rotationally move the film clamping fingers or members 36,38, which are still disposed in their OPENED state, from their LOWERED position as illustrated in FIGS. 6 and 7 to their RAISED position as illustrated in FIG. 8, as a result of the rotary or pivotal movement of the rotary shaft 90 of the rotary actuator 86, in preparation for the final phase of the film wrapping or packaging operation or cycle. As best seen in FIG. 1, the new and improved packaging or wrapping machine or system 10 is seen to further include a film welding mechanism 98 and a film cutting mechanism 100 integrally mounted together upon a pivotal arm assembly 102 which is pivotally mounted upon an upstanding standard 104 between retracted and extended positions. Suitably controlled pivotal movement of the pivotal arm assembly 102 to the extended dotted line position 102' will therefore move the film welding mechanism 98 to its dotted line position 98' and into contact with that portion of the packaging or wrapping film that extends from the supply roll 30 of the wrapping or packaging film to the wrapped or packaged load 20 so as to force a portion of the wrapping or packaging film into contact with that side surface portion of the load 20 which is disposed opposite or faces the carriage assembly 28. Energization of the film welding mechanism 98 therefore secures that portion of the wrapping or packaging film upon the wrapped or packaged load through means of film welding processing or techniques which are conventional or well known in the art.

Simultaneously therewith, such pivotal movement of the film welding mechanism 98, and the consequent movement of the noted portion of the wrapping or packaging film into contact with the side surface portion of the load 20, also positions another portion of the wrapping or packaging -film over the clamping fingers or members 36,38 which, it will be remembered, are disposed in their RAISED and OPENED positions. Accordingly, the pneumatic actuator 56 can now be actuated so as to again extend the piston rod 60 thereof whereby the film clamping fingers or members 36,38 will be moved from their OPENED positions as illustrated within FIG. 8 to their original CLOSED position as illustrated within FIG. 4 so as to effectively and securely clamp that portion of the wrapping or packaging film which was disposed above the clamping fingers or members 36,38 as a result of the aforenoted pivotal movement of the film welding mechanism 98.

In addition, as a result of the pivotal movement of the pivotal arm assembly 102 to the dotted line position 102', the film cutting mechanism 100, which may comprise a conventional hot-wire element, is likewise moved to its dotted line position 100' so as to be disposed in contact with that portion of the packaging or wrapping film which extends from the film clamping mechanism 34 to the load 20. Energization of the film cutting mechanism 100 thereby severs that portion of the packaging or wrapping film which extends from the film clamping mechanism 34 to the load 20 and effectively creates a trailing end or tail portion integral with the load 20 as well as a leading end or tail portion which is clamped within the film clamping mechanism 34 in preparation for the commencement of a new load wrapping or packaging operation or cycle. The film wrapping or packaging operation or cycle, in connection with the load

20, is now complete, the pivotal arm assembly 102 may be retracted back to its solid line position, and if desired, the trailing end or tail portion of the wrapping or packaging film integrally fixed upon the load 20 may optionally be wiped down and adhered to the packaging or wrapping film wrapped around the load 20 by means of a suitable, conventionally known wipedown brush mechanism. Subsequently, the conveyor system 11 may be actuated whereby the wrapped or packaged load 20 is conveyed out from the wrapping or packaging station 16 by means of the outfeed conveyor 14 while the infeed conveyor 12 may convey a new load into the wrapping or packaging station 16 in preparation for the commencement of a new film wrapping or packaging operation or cycle.

Thus, it may be seen that in accordance with the principles and teachings of the present invention, there has been disclosed a new and improved film packaging or wrapping machine or system which has incorporated therein a new and improved packaging or wrapping film clamping mechanism which in addition to being conventionally movable between CLOSED and OPENED positions so as to respectively be capable of clamping or releasing a portion of the wrapping or packaging film at predetermined times of a film wrapping or packaging operation or cycle, is also pivotally movable through an arcuate extent of 90° between vertically RAISED and horizontally LOWERED positions so as to, for example, respectively initially clamp a portion of the packaging or wrapping film at the end of a wrapping or packaging operation or cycle in preparation for the commencement of a new film wrapping or packaging operation or cycle, and to permit a film wrapping or packaging operation or cycle to be conducted without interference with the lowermost positional disposition of the carriage assembly upon which the supply roll of wrapping or packaging film is disposed. In this manner, the packaging or wrapping film can be applied to the lowermost regions of the load being wrapped or packaged such that loads having relatively small height dimensions can be securely wrapped or packaged, and in addition, a savings in operational or cyclic time, as well as the amount of wrapping or packaging film required for the performance of a particular load wrapping or packaging operation or cycle, can be achieved.

Obviously, many variations and modifications of the present invention are possible in light of the above teachings. For example, while the disclosure has illustrated the film wrapping apparatus, machine, or system, in connection with which the film clamping system of the present invention has been employed, as comprising a turntable upon which the load to be wrapped is disposed when the load is positioned at the wrapping station, the teachings and principles of the present invention can likewise be applied to those film wrapping or packaging systems, machines, or apparatus wherein the load to be wrapped is disposed at a stationary wrapping station, and the carriage assembly, upon which the supply roll of wrapping or packaging film is disposed, is mounted upon an arm which rotates around the load wrapping station. It is therefore to be understood that within the scope of the appended claims, the present invention may be practiced otherwise than as specifically described herein.

What is claimed as New and Desired to be Protected by Letters Patent of The United States of America, is:

1. A film clamping mechanism for use in connection with film wrapping apparatus for wrapping loads, disposed at a wrap-ping station, within wrapping film, comprising:

a pair of film clamping members;

first means operatively connected to said pair of clamping members for moving said pair of film clamping members between first CLOSED and second OPENED positions with respect to each other for respectively clamping and releasing a portion of wrapping film during predetermined times of a load wrapping operation;

second means operatively connected to said pair of clamping members for moving said pair of film clamping members between first RAISED and second LOWERED positions during predetermined times of a load wrapping operation, and for operatively cooperating with said first means; and means for controlling said first and second means such that said pair of film clamping members can be disposed at RAISED and CLOSED positions, LOWERED and CLOSED positions, LOWERED and OPENED positions, and RAISED and OPENED positions during predetermined times of a load wrapping operation.

2. The film clamping mechanism as set forth in claim 1, wherein:

said second means is operatively connected to said pair of clamping members and is actuated so as to dispose said pair of clamping members at said first RAISED position while said first means is operatively connected to said pair of clamping members and is actuated so as to dispose said pair of clamping members at said first CLOSED position such that said pair of clamping members grasp and retain a leading end portion of the wrapping film at the commencement of a film wrapping operation; and said second means is operatively connected to said pair of clamping members and is actuated so as to dispose said pair of clamping members at said second LOWERED position while said first means is operatively connected to said pair of clamping members and is actuated so as to dispose said pair of clamping members at said first CLOSED position such that said pair of clamping members can retain a leading end portion of the wrapping film in a clamped mode during the performance of a film wrapping operation.

3. The film clamping mechanism as set forth in claim 1, wherein:

said second means is operatively connected to said pair of clamping members and is actuated so as to dispose said pair of clamping members at said second LOWERED position while said first means is operatively connected to said pair of clamping members and is actuated so as to dispose said pair of clamping members at said second OPENED position such that said pair of clamping members can release a leading end portion of the wrapping film during the performance of a film wrapping operation in preparation for the secured fixation of the leading end portion of the wrapping film upon the wrapped load.

4. The film clamping mechanism as set forth in claim 1, wherein:

said second means is operatively connected to said pair of clamping members and is actuated so as to dispose said pair of clamping members at said first RAISED position while said first means is operatively connected to said pair of clamping members and is actuated so as to dispose said pair of clamping members at said second OPENED position in preparation for the grasping and retaining of a leading end portion of the wrapping film at the commencement of a film wrapping operation.

5. The film clamping mechanism as set forth in claim 1, wherein:

said first means for moving said pair of clamping members between said first CLOSED and second OPENED positions with respect to each other comprises a piston-cylinder actuator; and said second means for moving said pair of clamping members between said first RAISED and second LOWERED positions comprises a rotary actuator for moving said pair of clamping members through an arcuate movement of 90° wherein said first RAISED and second LOWERED positions are defined at extreme end positions of said 90° arcuate movement.

6. The film clamping mechanism as set forth in claim 5, wherein:

said piston-cylinder actuator and said pair of clamping members are mounted upon a first inner framework; and said rotary actuator is mounted upon a second outer framework and operatively connected to said first inner framework such that when said rotary actuator is rotationally actuated, said first inner framework is rotated through said 90° arcuate movement between said first RAISED and second LOWERED positions so as to in turn move said pair of clamping members between said first RAISED and second LOWERED positions.

7. The film clamping mechanism as set forth in claim 5, wherein:

a pair of gears are respectively mounted upon axle shafts of said pair of clamping members and are enmeshed with each other;

a crank arm has a first end portion thereof fixedly mounted upon one of said pair of axle shafts; and a piston rod of said piston-cylinder actuator is operatively connected to a second end portion of said crank arm, whereby when said piston rod is moved in accordance with the actuation of said piston-cylinder actuator, said piston rod causes movement of said crank arm, said crank arm causes movement of said one of said pair of axle shafts, said one of said pair of axle shafts causes movement of a first one of said pair of gears, and said first one of said pair of gears causes movement of the second one of said pair of gears such that said pair of clamping members are moved between said first CLOSED and second OPENED positions.

8. The film clamping mechanism as set forth in claim 1, wherein:

said means for controlling said first and second means comprises one of a programmable logic controller (PLC) and a central processing computer (CPU).

9. Film wrapping apparatus for packaging loads within wrapping film, comprising:

a wrapping station at which a load to be wrapped is disposed;

a carriage assembly, upon which a supply roll of wrapping film is disposed, for relative movement both vertically and rotationally with respect to said wrapping station at which the load to be wrapped is disposed; and a film clamping mechanism clamping and releasing a portion of the wrapping film withdrawn from the supply roll of wrapping film during predetermined times of a load wrapping operation, said film clamping mechanism comprising a pair of film clamping members; first means operatively connected to said pair of clamping members for moving said pair of film clamping members between first CLOSED and second OPENED positions with respect to each other for respectively clamping and releasing a portion of wrapping film during predetermined times of a load wrapping operation; second means operatively connected to said pair of clamping members for moving said pair of film clamping members between first RAISED and second LOWERED positions during predetermined times of a load wrapping operation, and for operatively cooperating with said first means; and means for controlling said first and second means such that said pair of film clamping members can be disposed at RAISED and CLOSED positions, LOWERED and CLOSED positions, LOWERED and OPENED positions, and RAISED and OPENED positions during predetermined times of a load wrappings operation.

10. The film wrapping apparatus as set forth in claim 9, wherein:

said second means is operatively connected to said pair of clamping members and is actuated so as to dispose said pair of clamping members at said first RAISED position while said first means is operatively connected to said pair of clamping members and is actuated so as to dispose said pair of clamping members at said first CLOSED position such that said pair of clamping members grasp and retain a leading end portion of the wrapping film at the commencement of a film wrapping operation; and said second means is operatively connected to said pair of clamping members and is actuated so as to dispose said pair of clamping members at said second LOWERED position while said first means is operatively connected to said pair of clamping members and is actuated so as to dispose said pair of clamping members at said first CLOSED position such that said pair of clamping members can retain a leading end portion of the wrapping film in a clamped mode during the performance of a film wrapping operation.

11. The film wrapping apparatus as set forth in claim 9, wherein:

said second means is operatively connected to said pair of clamping members and is actuated so as to dispose said pair of clamping members at said second LOWERED position while said first means is operatively connected to said pair of clamping members and is actuated so as to dispose said pair of clamping members at said second OPENED position such that said pair of clamping members can release a leading end portion of the wrapping film during the performance of a film wrapping operation in preparation for the secured fixation of the leading end portion of the wrapping film upon the wrapped load.

12. The film wrapping apparatus as set forth in claim 9, wherein:

said second means is operatively connected to said pair of clamping members and is actuated so as to dispose said pair of clamping members at said first RAISED position while said first means is operatively connected to said pair of clamping members and is actuated so as to dispose said pair of clamping members at said second OPENED position in preparation for the grasping and retaining of a leading end portion of the wrapping film at the commencement of a film wrapping operation.

13. The film wrapping apparatus as set forth in claim 9, wherein:

said first means for moving said pair of clamping members between said first CLOSED and second OPENED positions with respect to each other comprises a piston-cylinder actuator; and said second means for moving said pair of clamping members between said first RAISED and second LOWERED positions comprises a rotary actuator for moving said pair of clamping members through an arcuate movement of 90° wherein said first RAISED and second LOWERED positions are defined at extreme end positions of said 90° arcuate movement.

14. The film wrapping apparatus as set forth in claim 13, wherein:

said piston-cylinder actuator and said pair of clamping members are mounted upon a first inner framework; and said rotary actuator is mounted upon a second outer framework and operatively connected to said first inner framework such that when said rotary actuator is rotationally actuated, said first inner framework is rotated through said 90° arcuate movement between said first RAISED and second LOWERED positions so as to in turn move said pair of clamping members between said first RAISED and second LOWERED positions.

15. The film wrapping apparatus as set forth in claim 13, wherein:

a pair of gears are respectively mounted upon axle shafts of said pair of clamping members and are enmeshed with each other;

a crank arm has a first end portion thereof fixedly mounted upon one of said pair of axle shafts; and a piston rod of said piston-cylinder actuator is operatively connected to a second end portion of said crank arm, whereby when said piston rod is moved in accordance with the actuation of said piston-cylinder actuator, said piston rod causes movement of said crank arm, said crank arm causes movement of said one of said pair of axle shafts, said one of said pair of axle shafts causes movement of a first one of said pair of gears, and said first one of said pair of gears causes movement of the second one of said pair of gears such that said pair of clamping members are moved between said first CLOSED and second OPENED positions.

16. The film wrapping apparatus as set forth in claim 9, wherein:

said film wrapping station is defined by means of a rotary turntable.

17. The film wrapping apparatus as set forth in claim 9, further comprising:

film welding means, pivotally movable between retracted and extended positions, for moving a portion of the wrapping film into engagement with the wrapped load so as to secure the portion of the wrapping film onto the wrapped load at the conclusion of the wrapping operation; and a film cutting means, pivotally movable along with said film welding means, for severing a portion of the wrapping film extending between the wrapped load and said film clamping mechanism for creating a trailing end portion of the wrapping film upon the wrapped load and a leading end portion of the wrapping film clamped within said film clamping mechanism in preparation for a new load wrapping operation.

18. The film wrapping apparatus as set forth in claim 9, wherein:

said means for controlling said first and second means comprises one of a programmable logic controller (PLC) and a central processing computer (CPU).

19. A method of operating a film clamping mechanism for use in connection with a film wrapping apparatus for wrapping loads, disposed at a wrapping station, within wrapping film supplied from a supply roll of wrapping film, comprising the steps of:

providing a pair of film clamping members within the vicinity of said wrapping station at which the load to be wrapped is disposed;

moving said pair of film clamping members between first CLOSED and second OPENED positions with respect to each other for respectively clamping and releasing a portion of the wrapping film during predetermined times of a load wrapping operation; and moving said pair of film clamping members between first RAISED and second LOWERED positions during predetermined times of the load wrapping operation; and controlling said film clamping members at predetermined times of the load wrapping operation such that said pair of film clamping members can be disposed at RAISED and CLOSED positions, LOWERED and CLOSED positions, LOWERED and OPENED positions, and RAISED and OPENED positions during predetermined times of the load wrapping operation.

20. The method as set forth in claim 19, further comprising the steps of:

disposing said pair of clamping members at said first RAISED position while disposing said pair of clamping members at said first CLOSED position such that said pair of clamping members grasp and retain a leading end portion of the wrapping film at the commencement of the film wrapping operation; and disposing said pair of clamping members at said second LOWERED position while disposing said pair of clamping members at said first CLOSED position such that said pair of clamping members can retain the leading end portion of the wrapping film in a clamped mode during the performance of the film wrapping operation.

21. The method as set forth in claim 19, further comprising the step of:

disposing said pair of clamping members at said second LOWERED position while disposing said pair of clamping members at said second OPENED position such that said pair of clamping members can release the leading end portion of the wrapping film during the performance of the film wrapping operation in preparation for the secured fixation of the leading end portion of the wrapping film upon the wrapped load.

22. The method as set forth in claim 19, further comprising the step of:

disposing said pair of clamping members at said first RAISED position while disposing said pair of clamping members at said second OPENED position in preparation for the grasping and retaining of a leading end portion of the wrapping film at the commencement of the film wrapping operation.

23. The method as set forth in claim 19, further comprising the steps of:

disposing said pair of clamping members at said first RAISED position while said pair of clamping members are disposed at said first CLOSED position so as to retain a leading end portion of a wrapping film, extending from supply roll of wrapping film, at the commencement of a film wrapping operation;

moving said pair of clamping members from said first RAISED position to said second LOWERED position, while said pair of clamping members are maintained at said first CLOSED position, so as to retain the leading end portion of the wrapping film in a clamped state during the performance of the film wrapping operation;

moving said pair of clamping members from said first CLOSED position to said second OPENED position, while said pair of clamping members are maintained at said second LOWERED position, so as to release the leading end portion of the wrapping film from said pair of clamping members in preparation for fixedly securing the leading end portion of the wrapping film to the wrapped load;

moving said pair of clamping members from said second LOWERED position to said first RAISED position, while said pair of clamping members are maintained at said second OPENED position, in preparation for receiving a new portion of the wrapping film between said OPENED pair of clamping members;

moving said pair of clamping members from said second OPENED position to said first CLOSED position, while said pair of clamping members are maintained at said first RAISED position, so as to clamp the new portion of the wrapping film between said CLOSED pair of clamping members; and cutting a portion of the wrapping film at a location between said pair of clamping members and the wrapped load so as to simultaneously form a trailing end portion of the wrapping film which is attached to the wrapped load and a leading end portion of the wrapping film within said CLOSED pair of clamping members in preparation for a new film wrapping operation.

24. The method as set forth in claim 19, further comprising the step of:

using one of a programmable logic controller (PLC) and a central processing computer (CPU) for controlling said film clamping members.

* * * * *